US007086799B1

(12) United States Patent
Pappageorge et al.

(10) Patent No.: US 7,086,799 B1
(45) Date of Patent: Aug. 8, 2006

(54) MARKER

(75) Inventors: George Pappageorge, Englewood, NJ (US); Javier Rueda, Englewood, NJ (US)

(73) Assignee: Arro-Mark Company LLC, Englewood, NJ (US)

( * ) Notice: Subject to any disclaimer, the term of this patent is extended or adjusted under 35 U.S.C. 154(b) by 0 days.

(21) Appl. No.: 11/077,548

(22) Filed: Mar. 10, 2005

(51) Int. Cl.
*B43K 5/00* (2006.01)

(52) U.S. Cl. ..... 401/206; 401/205

(58) Field of Classification Search ..... 401/198, 401/199, 205, 206
See application file for complete search history.

(56) References Cited

U.S. PATENT DOCUMENTS 5,411,345 A * 5/1995 Ueji et al. ..... 401/206
6,599,046 B1 * 7/2003 Fukushima et al. ..... 401/206

* cited by examiner

*Primary Examiner*—David J. Walczak
(74) *Attorney, Agent, or Firm*—Thomas A. O'Rourke; Bodner & O'Rouke, LLP

(57) ABSTRACT

An improved writing marker, which may be suitable for distribution of various writing liquids to the writing surfaces. The device has a barrel for containing the writing liquid, and a mechanism for application of the liquid upon the writing surface. A barrel has an open end through which it is connected to a marker's body to provide a flow into the closure formed by the inner surfaces of the mechanism for the application of the writing liquid that further comprises a stem member configured into a stem closure which is secured within the marker's body.

13 Claims, 14 Drawing Sheets

FIG. 5
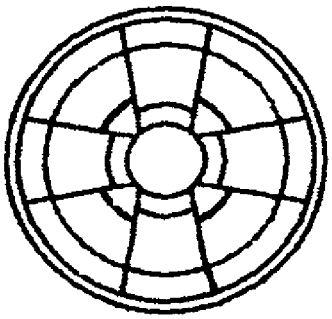
FIG. 6
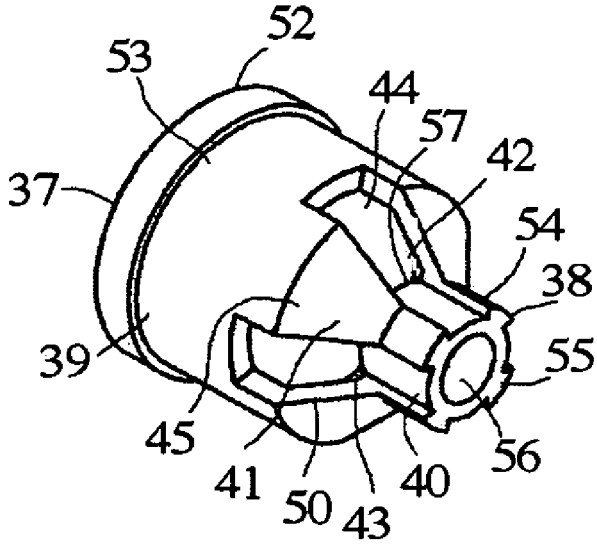
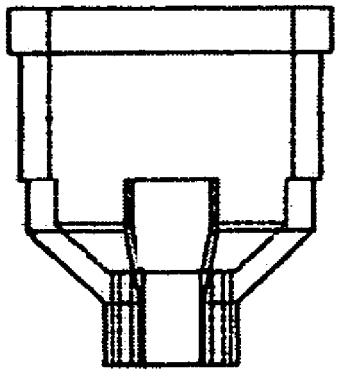
FIG. 7

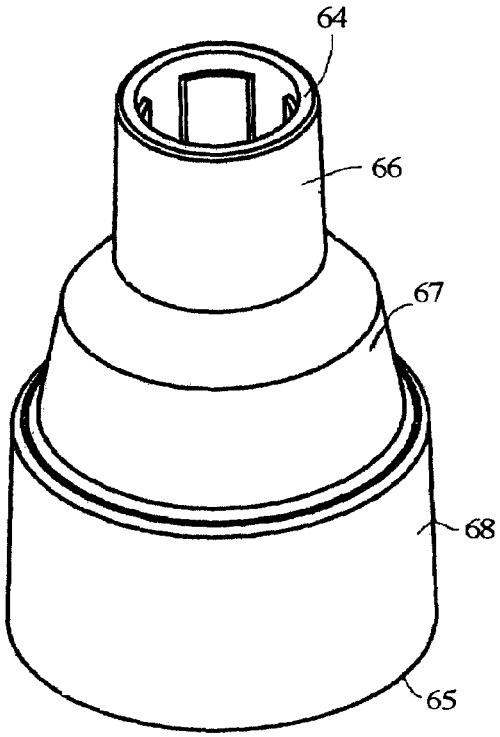
FIG. 8
FIG. 9
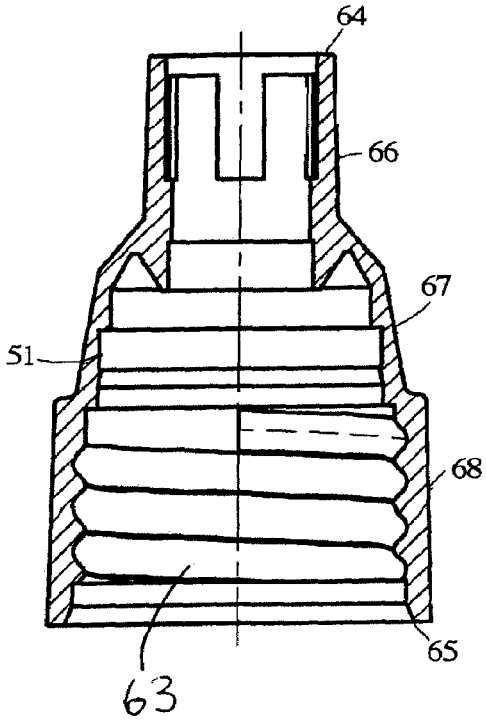

FIG. 10
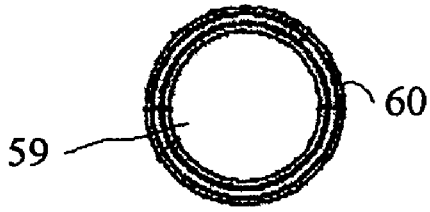
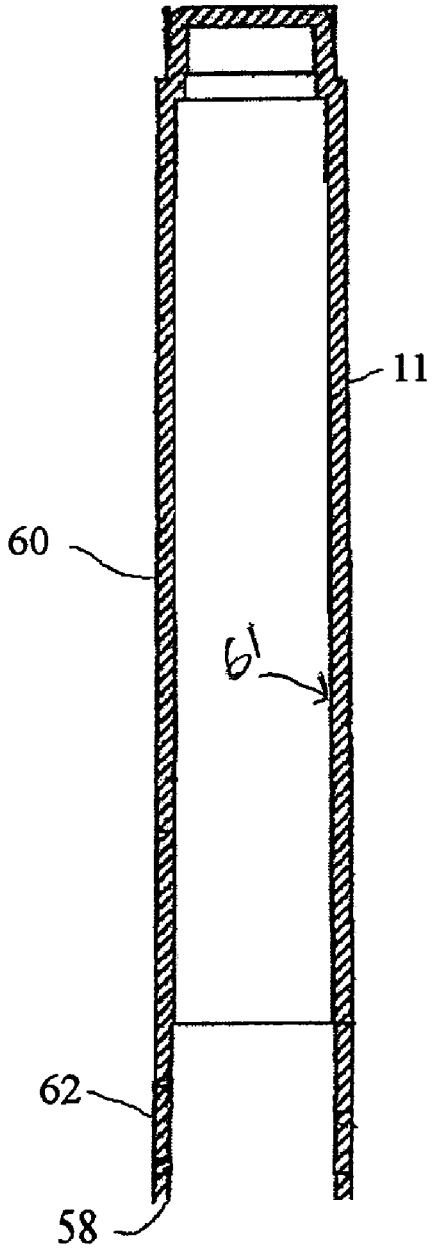
FIG. 11

FIG. 12
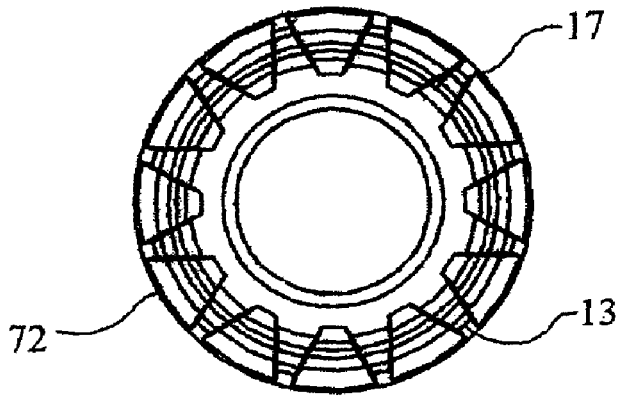
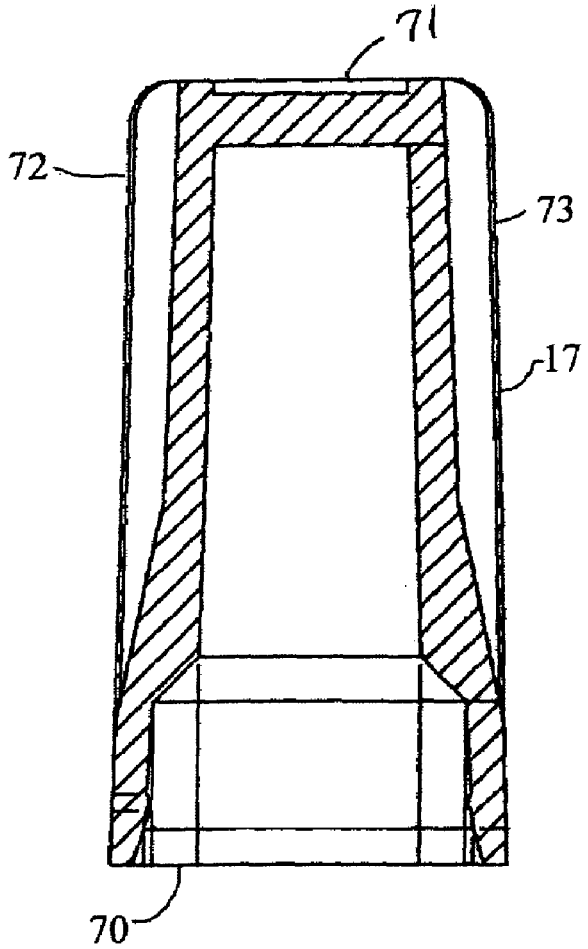
FIG. 13

FIG. 23
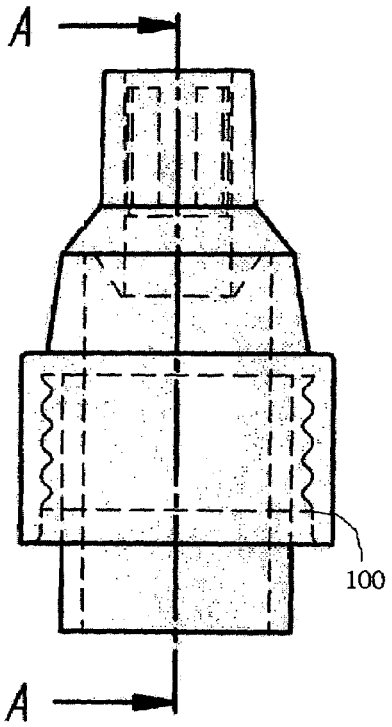
FIG. 24
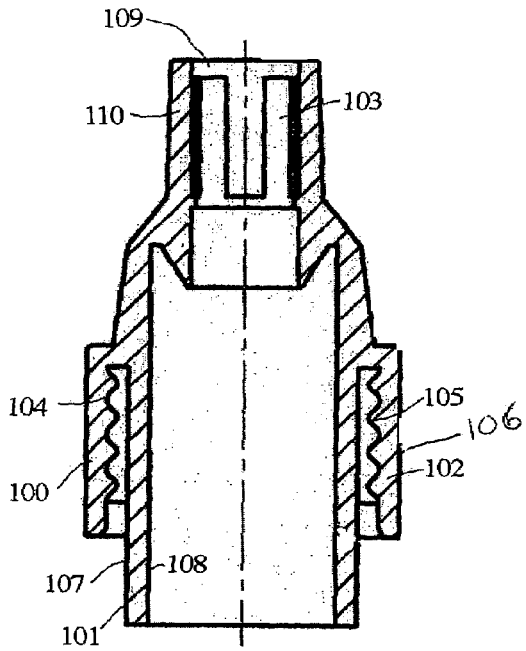
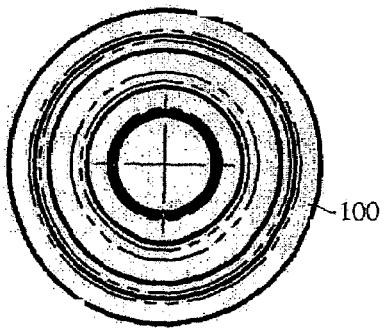
FIG. 25
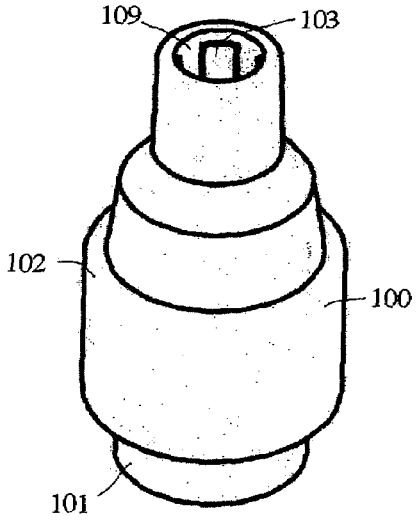
FIG. 26

MARKER

FIELD OF THE INVENTION

This invention is related to the device for distribution and dispensing of liquid upon the surfaces for the purposes of writing, marking etc.

BACKGROUND OF THE INVENTION

There are a large number of types of non electronic, handheld devices for marking or writing with ink, dye, pigment or paint, etc. Such devices include pencils, ballpoint pens, fountain pens, felt tip pens, capillary tube pens and others. There are also a large number of non electronic devices for dispensing various other viscous and non viscous liquid products including but not limited to oil, grease and insect repellant and others. One common type of marking device has been the ubiquitous "felt tip marking pen". While the tips of pens used to be made of felt, today they are usually made from an acrylic material, a polyester fiber or other suitable material. Marking pens have a barrel or reservoir for holding a quantity of ink. The ink may be water based; alcohol based or made using any number of other types of solvents. The barrel typically has a flat bottom or base so that the pen may stand. Opposite the base is a shoulder that tapers to a neck. In an opening in the neck there is a felt tip for writing. The porous tip or nib has one end which is used to write with while the other end is in contact with the ink supply. Capillary action permits the ink to flow from the reservoir to the writing end of the tip. One type of marker has one end of the writing nib directly in contact with the ink reservoir. As the pen is used, ink flows by gravity down the barrel to the end of the tip. The ink flows through the tip or nib to the writing surface. In another type of marking pen the end of the tip opposite the writing surface does not contact the reservoir directly. In order for ink to contact the tip, the tip must be pushed towards the reservoir which causes ink to flow from the reservoir to the tip thereby providing the tip with a quantity of ink for use. When the tip is released a spring forces the tip outwardly of the container and closes off the ink passageway from the reservoir to the tip. Examples of prior art marking pens of this type are shown in U.S. Pat. No. 4,685,820, U.S. Pat. No. 4,792,2252, U.S. Pat. No. 4,848,947 to Kremer et. al. The disclosures of which are incorporated herein by reference. These patents relate to devices which use a valve to dispense a liquid or a powered solid to a brush or hard tip.

Many conventional markers have an embodiment where a fiber tip or other similar applicator of writing liquid is directly connected with a liquid supply container. In some variations of this embodiment the applicator becomes moisturized and is able to apply writing liquid to a writing surface as long as one end of an applicator communicates with writing liquid. Usually it occurs when a writing device is positioned with the tip downwardly such as contacting a writing surface. Because a porous material is used for manufacturing of applicators of markers, a writing liquid is consumed not only through the application of such liquid to a writing surface but also through vaporization of such liquid from the surface of writing applicator that remains exposed to the air during a process of writing or when marker is not in use but remain uncapped. Usually, when marker is not in use, the cap may be attached to the latter to isolate the writing applicator from the surrounding atmosphere and to prevent or reduce vaporization of the writing liquid from a surface of the felt tip or other writing applicator. For household use, it is possible for consumer to attach such cap every time the marker is not used. On the other hand, when used for commercial purposes, it may be inconvenient for a user to remove and then to attach a cap every time a user wants to use a marker, particularly when the nature of the job requires relatively frequent use of such marker. Moreover, frequent repeated operation of removing and replacing of a cap may result that the cumulative time spent by a user upon such operations increases substantially thus reducing productivity. In contrast, if a user decides to keep a marker uncapped from use to use in order to save time, a writing liquid from a liquid container would vaporize; because in most conventional markers the writing applicator is directly connected with the supply container and if left uncapped, the writing liquid freely vaporizes through the felt tip or other similar applicator capable to transmit direct communication between container with writing liquid and a writing surface through the process of moisturizing of the applicator.

Continuing efforts have been made in the past to improve a design of such markers to improve flow of ink and reduce evaporation and particularly in the mechanism through which the writing liquid may flow from a container or any other member that allows storage of such liquid to a writing surface. Most inventions employ valve mechanisms with bias means that allow a writing liquid to flow from a container with such liquid to a writing applicator. In many embodiments a depression of a writing end of a writing applicator upon a writing surface causes a valve to open allowing a flow of a liquid. A valve closure in such mechanisms provides sealing of a container through bias means usually incorporated into such sealing. Many prior art devices employ relatively complicated structure of the valve, very often consisting of several interrelated parts that require complex assembly, driving up cost of manufacturing of such markers. In the past, assembly of the prior art devices was a large issue due to the complexity of the prior arts internal mechanisms. The more intricate the internal mechanism of a marking device was the more it was expensive to produce such device. Prior art required hand assembly or intricate automated assembly method to assemble the devices. As the complexity of assembly increases, so does the cost to perform quality assurance to detect defective units and diagnose what caused those units to be defective. Therefore, the reduction of complexity and number of parts necessary to assemble a marking device will decrease the cost of such marker.

The purpose of a prior art was having a valve mechanism which controlled the flow of the liquid product contained in the marking device was so that a large amount of said marking liquid could be contained in the device without being exposed to air. The valve acts as a shield against exposure to air so that the unused liquid would not dry up inside of the device, thus rendering the device useless. In some prior art devices problems arise when the liquid dries up in the valve, thus causing the valve to malfunction allowing all of the liquid to escape or allowing air to enter the liquid reservoir and dry out the marking liquid. The current invention defines reasonably simple and inexpensive design for a valve mechanism of a marker that allows easy assembly and completely refillable.

OBJECTS OF THE INVENTION

It is an object of the present invention to provide an improved marker that has long life and low cost.

Another object of the present invention is to provide an improved applicator device for dispensing an applicator material which may include but not be limited to die based materials and pigment based materials.

Another object of the present invention is to provide an improved applicator device with a valve which will increase the usable life of the material to be applied.

Another object of the present invention is to provide an improved applicator device which utilizes a valve which is less likely to become clogged.

Another object of the present invention is to provide a simpler valve which will reduce cost and complexity of assembly.

A further object of the invention is to provide a marker that may be used for a variety of water based inks.

A still further object of the invention is provide a marker that may be used for a variety of petroleum based inks including aromatic and aliphatic based inks, alcohol based inks and ether based inks including glycol ethers.

SUMMARY OF THE INVENTION

The present invention is directed to a writing liquid application device comprising a barrel container for such writing liquid secured to the body of the marker, and a valve mechanism. The body of the marker has a protective cap attached to its end. The valve mechanism may comprise a stem, a resistance providing member and a stem closure. The stem is movably positioned within the stem closure from a first or at rest position to a retracted or ink releasing second position. The stem also is frictionally secured to the writing applicator of the marker. The stem closure is secured within the body of the marker.

The valve mechanism provides the flow of the writing liquid from the barrel when the valve mechanism is in an open position and prevents such flow when the valve is in a closed position, respectively. A valve mechanism includes a resistance providing member for exerting force upon the stem to keep the valve mechanism in closed position. A writing applicator has one end for applying a writing liquid to a writing surface and the other end for receiving the stem and writing liquid. The stem is movable from the closed position to the open position when the writing applicator is depressed against a writing surface, allowing writing liquid to flow from the barrel and to communicate with the other end of the writing applicator.

The barrel includes open end, closed end and a sidewall. An open end of the barrel is secured to the body of the marker. The stem closure is press fitted into the open end of the body of the marker although in an alternative embodiment the body of the marker may have threads cut upon its outer surface threadably engaging with threads cut upon the inner surface of the body of the marker. The stem closure has an internal cavity that extends through its body and the stem may move back and forth toward and away from the tip of the marker within such cavity. Side walls of the stem closure have openings to provide a flow of the writing liquid into the internal cavity of the stem closure. The stem includes an annular projection at one end for engaging the annular collar of the body of the marker to form a seal when a resistance providing member forces the stem toward the body of the marker. A fiber tip applicator is frictionally attached to the stem trough one end and the other end is used as a writing applicator. A cap is provided for covering a writing end of the writing applicator.

The present invention is particularly useful because of the variety of inks that may be used in the marking pen without leaking. The inks that may be used, include but are not limited to water based inks, petroleum based inks including aromatic and aliphatic based inks, alcohol based inks and ether based inks including inks using glycol ethers.

BRIEF DESCRIPTION OF THE DRAWINGS

FIG. 5 is an end view of the stem closure of FIG. 1.

FIG. 6 is a perspective view of the stem of the marker of FIG. 5.

FIG. 7 is a side view of the marker of FIG. 5.

FIG. 8 is a perspective view of the marker's body of the marker of FIG. 1.

FIG. 9 is a side cut-away view of the marker's body of FIG. 8.

FIG. 10 is a top view of the barrel of FIG. 1.

FIG. 11 is a side cut-away view of the barrel of FIG. 10.

FIG. 12 is a top view of the cap of the marker of FIG. 1.

FIG. 13 is a side cut-away view of the cap of the marker of FIG. 12.

FIG. 23 is a side view of the alternative embodiment of the marker's body of FIG. 1.

FIG. 24 is a cut-away view of the alternative embodiment of the marker's body of FIG. 23.

FIG. 25 is a top view of the alternative embodiment of the marker's body of FIG. 23.

FIG. 26 is a perspective view of the alternative embodiment of the marker's body of FIG. 23.

DETAILED DESCRIPTION OF THE INVENTION

Figure 1:
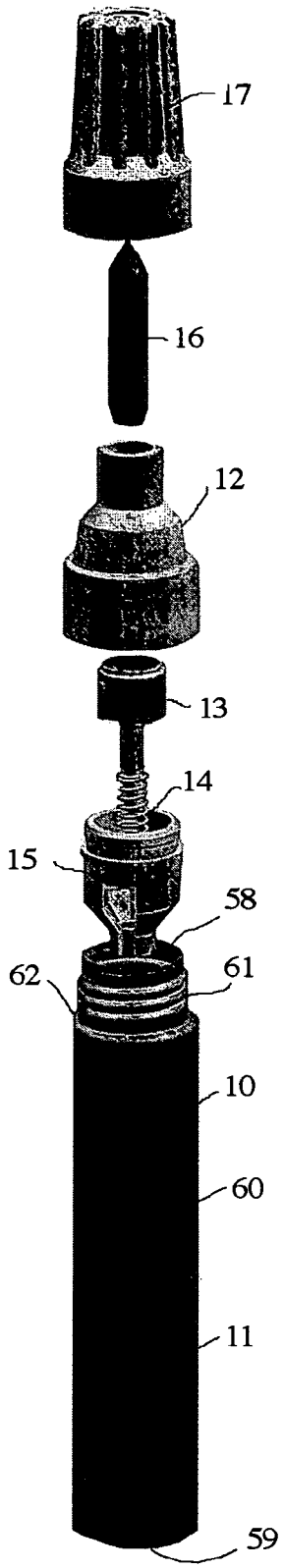
FIG. 1 is an exploded view of one embodiment of the marker of the present invention.
Figure 2:
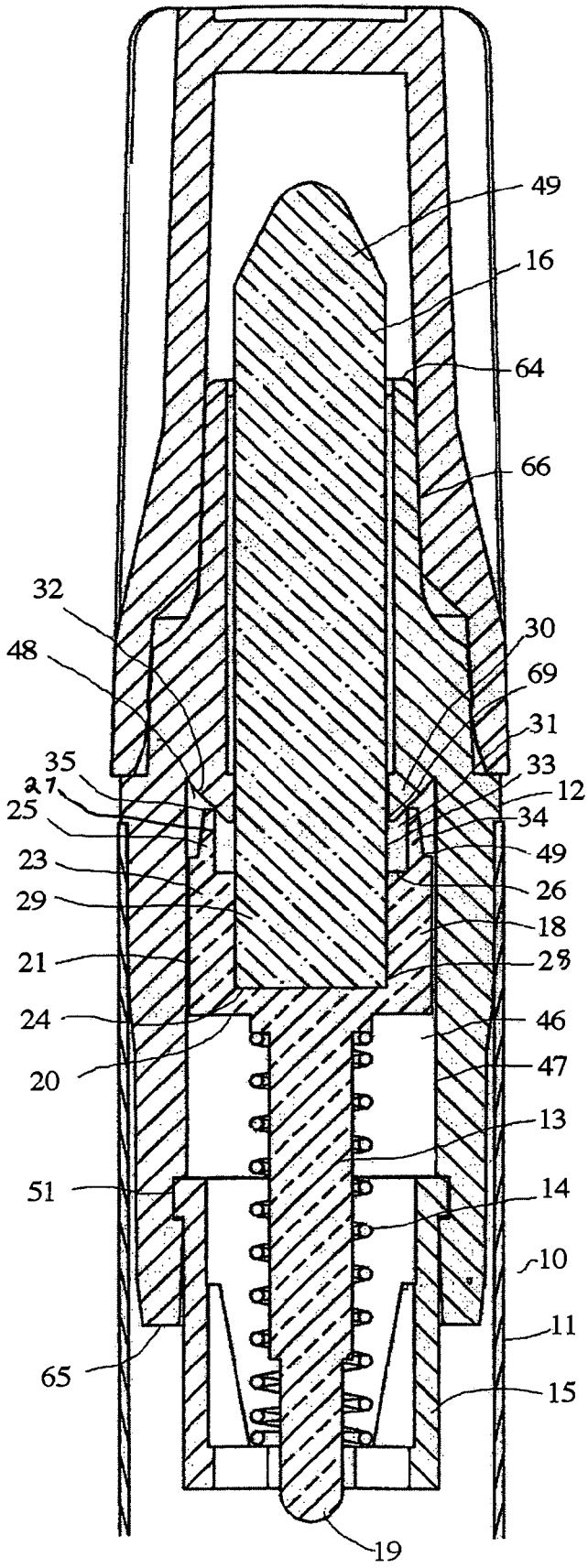
FIG. 2 is a cut away view of the marker of FIG. 1.
Figure 3:
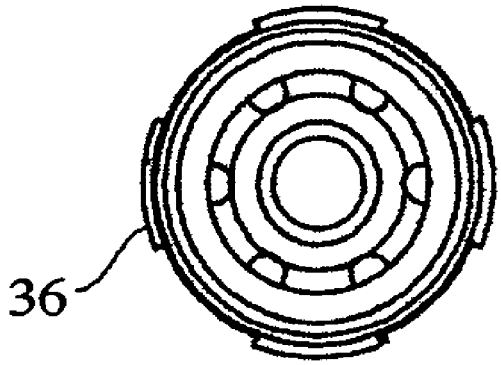
FIG. 3 is a top view of the stem member of the marker of FIG. 1.

As depicted in FIG. 1 and FIG. 2, an improved marker 10 of the present invention may include a barrel 11, a marker body 12, a stem member, 13, a resistance providing member 14, a stem closure 15, an applicator 16 such as a porous applicator and a cap 17. The stem member, 13 and the stem closure 15 are preferably made from plastic material. In addition, stem closure 15 may be constructed as a conical enclosure as depicted in FIG. 1, or as a rectangular enclosure, as depicted in FIG. 2. Although a resistance providing member 14 is embodied as a coil spring here, it would be appreciated that various other embodiments of such resistance providing member may be used. The barrel member has a reservoir for ink.

Figure 4:
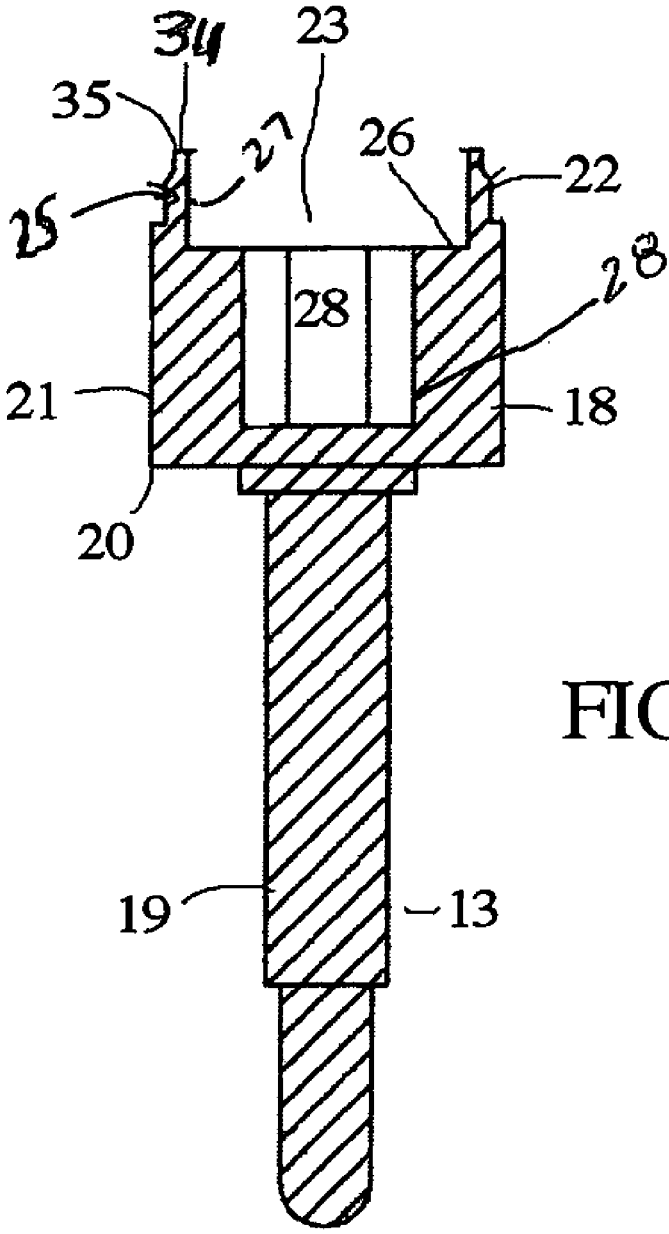
FIG. 4 is a side cut away view of the stem member of FIG. 3.
Figure 14:
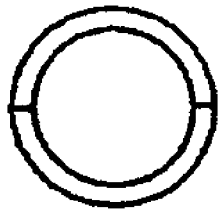
FIG. 14 is a top view of the spring member of the marker of FIG. 1.
Figure 15:
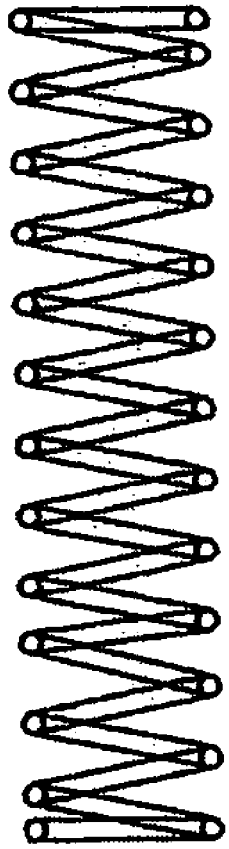
FIG. 15 is a side view of the spring member of FIG. 14.
Figure 21:
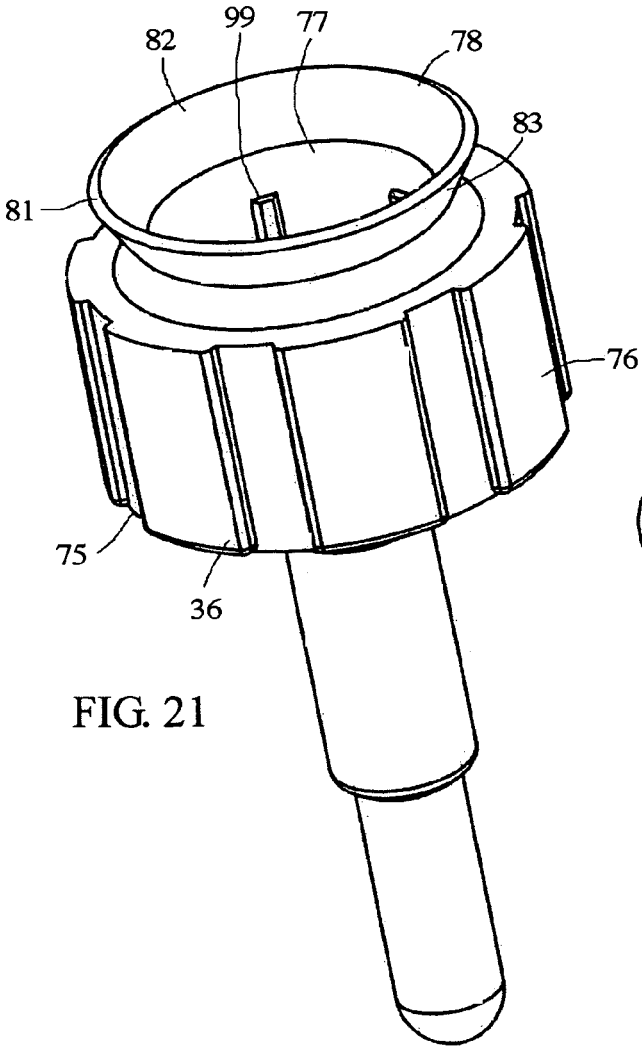
FIG. 21 is a top perspective view of the alternative embodiment of the stem member of FIG. 19.

As shown in FIG. 2, the stem member 13 is a cup-shaped configuration having a plug portion 18 and a shaft-like stem projection 19 integrally formed on the closed end 20 of the plug portion 18. The plug portion 18 of the stem member, 13 is generally of a cylindrical shape with a closed end 20, generally cylindrical side walls 21 and an open end 22. The plug portion 18 of the stem member, 13 may be hollow inside, forming the cavity 23. Such cavity 23 may be defined by the first end 24 and the second end 25 separated by the shoulder 26. The first end 24 may have inner circumferential surface 28 and the second end 25 may have the inner circumferential surface 27. The inner circumferential surface 28 of the first end 24 may be adopted to frictionally receive the end 29 of the felt applicator 16, thus the inner diameter and the length of the first end 24 may be such that to make it capable of receiving and thereafter retaining the end 29 of the felt applicator 16. In one embodiment, as shown in FIG. 2 and FIG. 4, the surface 28 of the inner wall of the first end 24 may be smooth. Yet in another embodiment, as depicted in FIG. 21, the surface may have friction ribs 99 for better retaining a proximal end of the felt applicator 98. The second end 25 of the plug portion 18 is formed as a hollow cylinder with inner circumferential surface 27 adopted to receive at least a portion of the conical projection 30 extending from the marker's body 12 to form a seal between the stem member, 13 and the marker's body 12 to provide controlled flow of the liquid from the barrel 11 into the marker's body 12. As may be seen from the FIG. 1 and FIG. 2, the liquid from the barrel 11 may enter the internal cavity 31 formed by and extending therebetween the inner circumferential surface 27 of the second end 25 of the plug portion 18 of the stem member, 13, the outer surface 32 of the conical projection 30 of the marker's body 12, the surface of the flared shoulder 26 and the outer surface 33 of the felt applicator 16. The distal edge 34 of the second end 25 of the plug portion 18 may form an annular sealing seat, or collar, 35. Such sealing seat or collar 35 may circumvent around the outer surface 32 of the conical projection 30 of the marker's body 12. The separation of the sealing seat, or collar 35 from the sealing outer surface 32 of the conical projection 30 may permit the flow of liquid to enter from the barrel 11 into the chamber 31 and thus to the surface 33 of the felt applicator 16.

The shape of the circumferential surface 27 and the conical projection 30 are designed so that the movement of the spring forcing the stem member upwardly creates a mating between the circumferential surface 27 and the conical projection 30.

The depression of the felt applicator 16 will compress the spring member 14 to separate the sealing seat, or collar 35 of the second end 25 of the plug portion 18 of the stem 13 from the sealing outer surface 32 of the conical projection 30 of the marker's body in order a liquid to flow into the chamber 31.

Figure 20:
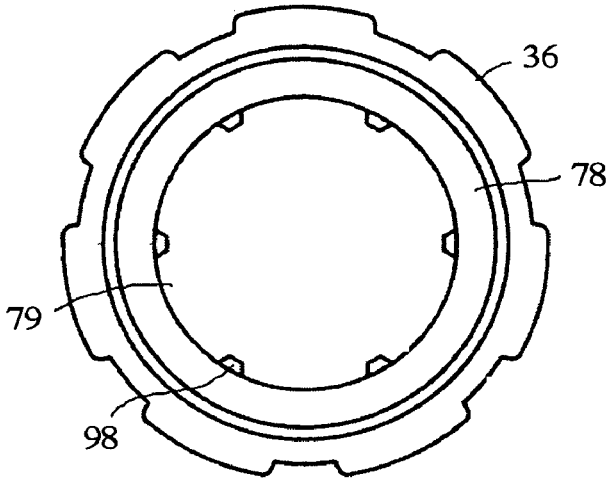
FIG. 20 is a bottom view of the alternative embodiment of the stem member of FIG. 19.
Figure 22:
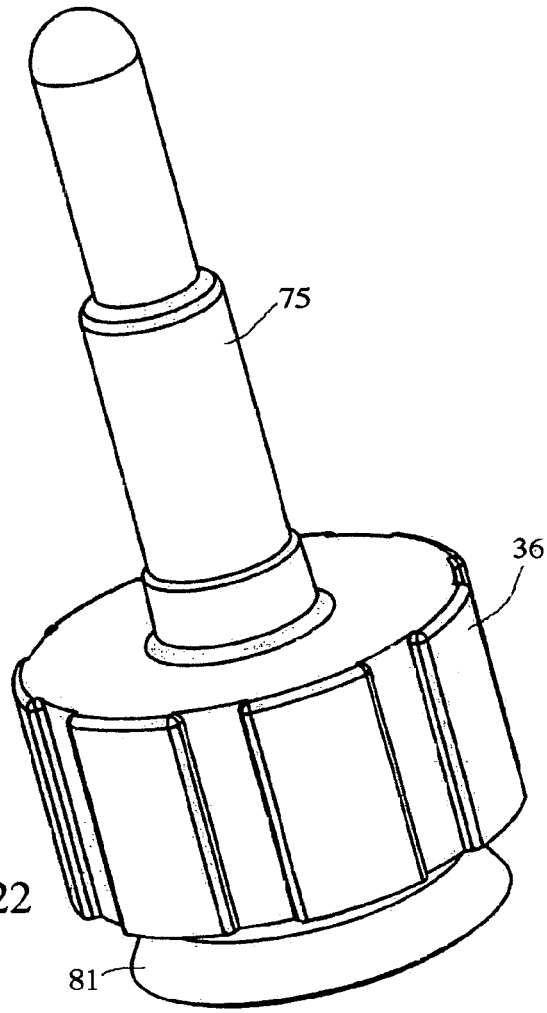
FIG. 22 is a bottom perspective view of the alternative embodiment of the stem member of FIG. 19.

A plurality of strengthening ribs 36 may be formed on the outer walls 21 of the plug portion 18 of the stem member 13 and extend along the outside surface of such cylindrical sidewalls 21, as shown in FIG. 20 through FIG. 22.

As depicted in FIG. 6, the stem closure 15 has a first end 37 and a second end 38 and defines two generally cylindrically shaped portions 39 and 40 and a generally conical portion 41 between with internal closure cavity 42 extending between portion 39 and the distal end 43 of the conical portion 41. The conical portion 41 has traversed apertures 44 along the outer surface 45 of such conical portion 41 that the liquid may flow from the barrel 11 toward cavity 31 through the openings 44 in the stem closure 15, then to the cavity 46 formed by inner cylindrical walls 47 of the marker's body 12, then, forced by gravity, through the space provided between inners walls 47 of marker's body 12 and the outer walls 21 of the plug portion 18 of the stem member 13 into the cavity 48 formed by outer walls 49 of the second end 25 of the plug portion 18 of the stem member, 13, the inner walls 47 of the marker's body 12 and the outer surface 32 of the conical portion 30 of the marker's body 12.

It may be seen in FIG. 2 that when the stem is in closed position, at least a portion of the sealing seat or collar 35 is pressed against outer surface 32 of the conical collar 30 of the marker's body 12 and the writing liquid otherwise accumulated in the cavity 48 may not flow in the cavity 31. If desired, a flexible material could be used for either surface to improve the seal and prevent leakage. If the felt applicator's writing end 49 is depressed, the opposite end of felt applicator 16 pushes stem member, or projection 13 upward, disengaging sealing seat or collar 35, of the second end 25 of the plug portion 18 of the stem member, 13 and sealing surface 32 of the conical projection 30 allowing the writing liquid to transfer from the cavity 48 into cavity 31 thus providing communication between the barrel 11 and felt applicator 16. The release of the depressing pressure from the fiber applicator 16 will return the sealing seat 35 of the plug portion 18 of the stem member, 13 into sealing engagement with sealing surface 32 of the projection collar 30 of the marker's body 12 forced by the pressure of the coil spring 14 to stop the flow of the writing liquid from cavity 48 into cavity 31.

The stem closure 15 is joined with marker's body 12 in the current embodiment by the press or friction fit engagement. The marker's body 12 inner walls 47 may be provided with a circumferential inner recess 51 capable of receiving and retaining an annular projection 52 extending from the distal edge 53 of the first end 37 of the stem closure 15. In the assembled configuration, the annular projection 52 engages the inner circumferential recess 51 made in the inner wall 47 of the marker's body 12, thus the stem closure 15 may be joined together with marker's body 12 into a snap locking engagement.

The cylindrically shaped second end 38 of the stem closure 15 may have circumferential side wall 54 and an open face 55. The internal cavity 42 has a tapered section 50 which integrates into generally cylindrically shaped portion 40. The inner diameter 56 of the second end 38 is adopted to engage friction-free the projection 19 extending from the closed end 20 of the plug portion 18 of the stem member, 13. However, such inner diameter 56 of the first end 38 may be smaller than the diameter of the coil spring 14. Such embodiment may allow the movement of the stem member, 13 relative to the stem closure 15 while coil spring 14 positioned upon the portion 19 of the stem member, 13, may be compressed between the inner end 57 of the portion 40 of the stem closure 15 and surface of the closed end 20 of the plug portion 18 of the stem member, 13.

As may be seen from FIG. 1, a barrel 11 may be made from any suitable material including but not limited to a plastic or metallic material. A barrel may have an open end 58 and a closed end 59 and cylindrical side walls 60. The open end 58 may have threads 61 cut on its outer surface 62 to threadably engage with threads 63 cut on the inner cylindrical walls of the marker's body 12, as shown in FIG. 9. Yet, in another embodiment as depicted in FIG. 11, the open end of a barrel may have threads cut on its inner surface to threadably engage with threads cut on the outer cylindrical walls of the marker's body.

As depicted in FIG. 8 and FIG. 9 the marker's body is cylinder-shaped with open end 64, open end 65 and defines generally cylindrical portions 66, generally conical portion 67 and generally cylindrical portion 68. As shown in FIG. 9, the interior diameter of the portion 66 may be slightly larger then the outer diameter of the application felt to allow the latter to pass through the former to frictionally engage the inner circumferential surface 27 of the first end 24 of the stem member 13. As can be seen in FIG. 2, projection collar 30 is formed when the inside sidewall of portion 66 is connected to the inside sidewall of portion 68 via the inside connecting wall of conical portion 67. The inner circumferential walls of the projection collar 30 may generally be cylindrical where after reaching the apex and forming the annular seat 69 the outer wall of the projection collar 30 may generally be conical, thus forming sealing surface 32. At this point, the inner surface of the portion 67 may generally be cylindrical or be tapered away from the projection collar 30 until the circumferential recess 51 is formed on the inner surface of the portion 67. At this point, the inner surface of the portion 67 may integrate into the inner surface of the generally cylindrical portion 68 where the thread may be cut to threadably engage the thread 61 cut on the outer surface 62 of the barrel 11

In another embodiment, the marker's body 100, as depicted in FIG. 23 through FIG. 26, may have hollow cylinder-shaped inner wall 101 defined by cylindrical surfaces 107 and 108 and hollow cylinder-shaped outer wall 102 defined by cylindrical surfaces 105 and 106, the outer wall 102 having a diameter of the surface 106 generally larger than a diameter of surface 107 of the inner wall 101 in order to adopt cylindrical walls of a barrel between walls 102 and 101. The outer wall 102 may have threads 104 cut in its inner surface 105 to threadably engage with threads cut on the outer cylindrical walls of the barrel, however other mating arrangements of a barrel and a marker's body may be used. For example one can insert marker body 12 into barrel 11, and a friction fit can be implemented as depicted in FIG. 2; in the present embodiment the preferred attachment method is that depicted in FIG. 1. In addition, plurality of friction ribs 103 may be formed on the inner walls 109 of the first end 110 of the marker's body 100 and extend along the inside surface of inner walls 109 of such cylindrical sidewalls 110, as shown in FIG. 24 and FIG. 26 to frictionally adopt a felt applicator. The other portions of such embodiment of the marker' body may be generally similar to those described in greater details above.

Figure 16:
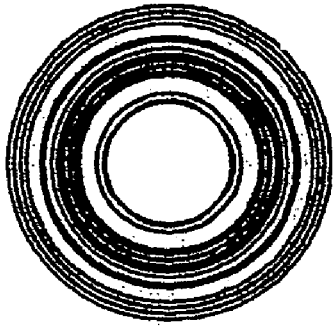
FIG. 16 is a top view of the marker's body of FIG. 1.
Figure 17:
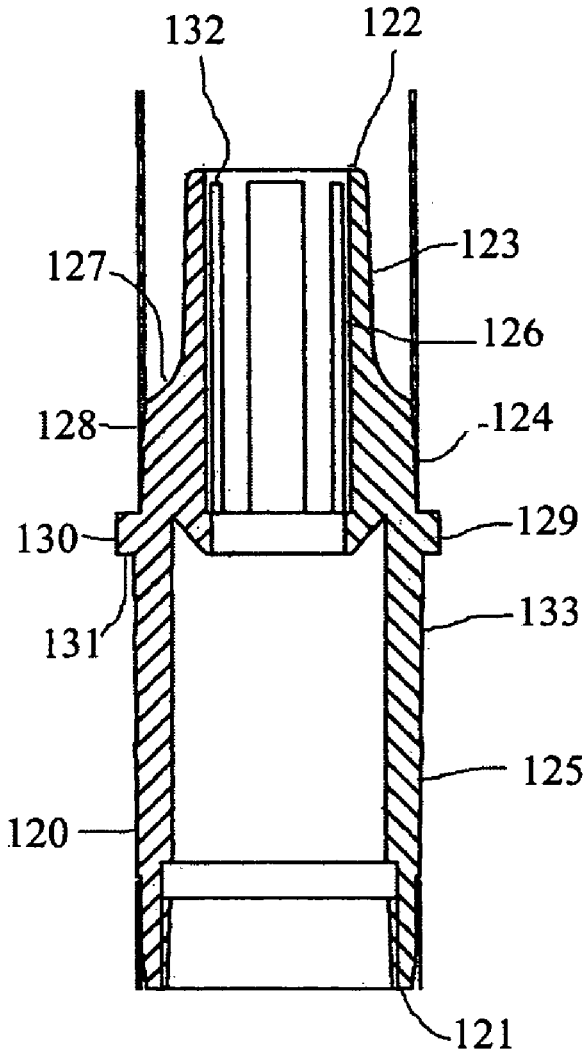
FIG. 17 is a cut-away side view of the marker's body of FIG. 16.

Another embodiment of the marker's body is depicted in FIG. 16 and FIG. 17. In such embodiment the marker's body 120 is cylinder shaped, having open first end 121 and open second end 122, defining generally cylindrical portions 123 and 124, generally conical portion 127 therebetween and generally cylindrical portion 125. The interior circumferential wall 126 of portion 123 may extend along both portions 123 and portion 124 having diameter slightly larger then the outer diameter of the application felt to allow the latter to pass through the first end 122 to engage the stem member in a manner as it was in details described above. Plurality of friction ribs 132, not shown, may be formed on the inner walls 126 and extend along the inside surface of such wall to frictionally adopt a felt applicator. Generally cylindrical portion 129 defined by the outer circumferential wall 130 may separate portions 123 and portion 125 making shoulder 131. Generally cylindrical outer wall of the portion 125 may have threads 133, as seen in FIG. 17, cut on its surface to threadably engage with threads cut on the inner cylindrical surface of barrel 11. The portion 125 is embodied to be insertably adopted into barrel 11 and thereafter the barrel and the marker's body are threadably mated. The outer edge of the barrel may threadably slide along the outer surface of the portion 125 until it pressed against the shoulder 131. The other portions of such embodiment of the marker' body may be generally similar to those described in greater details above.

Figure 18:
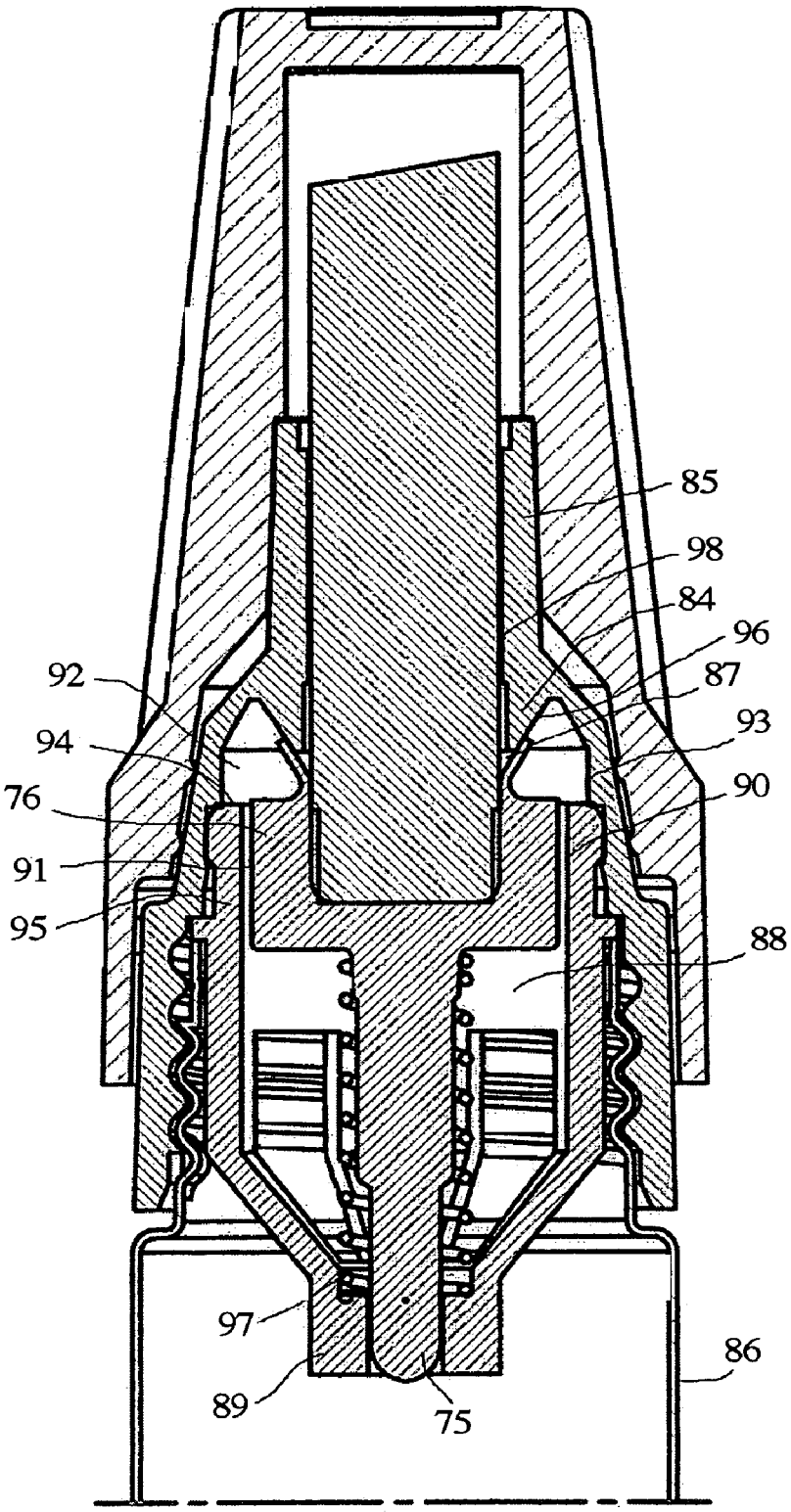
FIG. 18 is a cut-away view of the assembled alternative embodiment of the marker if FIG. 1.
Figure 19:
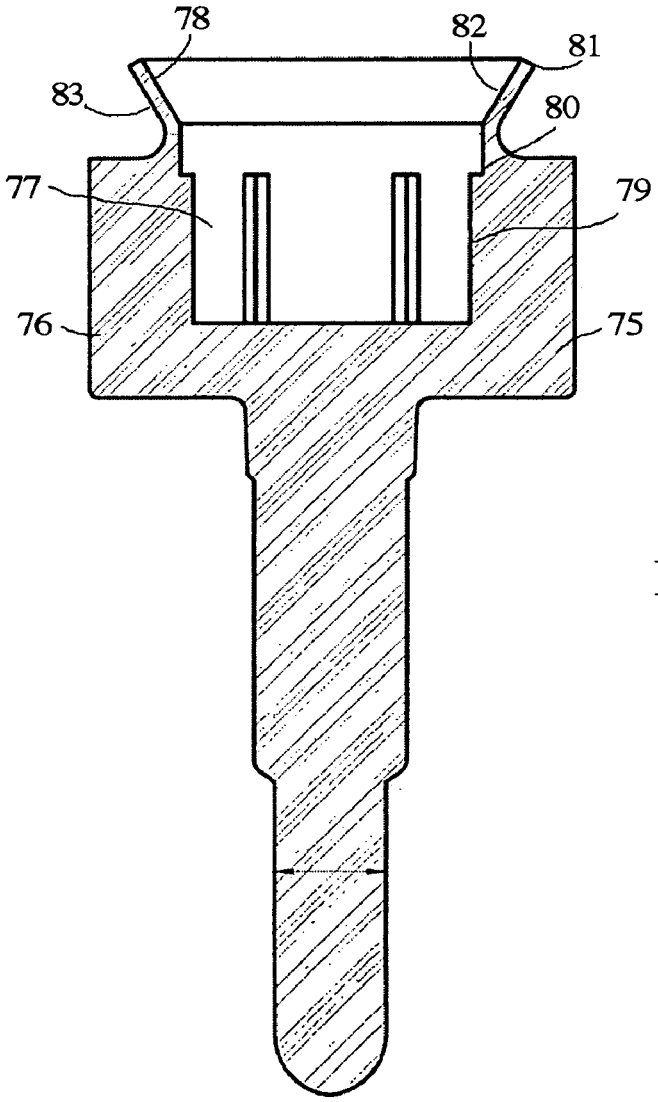
FIG. 19 is a cut-away side view of the alternative embodiment of the stem member of FIG. 1.

Yet another embodiment of the invention is depicted in FIG. 18 and FIG. 19 In such embodiment the plug portion 76 of the stem member 75 may be hollow inside forming cavity 77. Such cavity may be defined by first end 79 and second end 78 separated by shoulder 80.

The second end 78 may have cone-shaped projection 81 with inner circumferential surface 82 and outer circumferential surface 83. This cone-shaped projection 81 may be adopted to receive the collar 84 of the marker's body 85 to form a seal between the barrel 86 and felt applicator surface 98. In this embodiment the liquid may flow from the barrel 86 into the internal cavity 88 of the stem closure 89 then between inner circumferential wall 90 of the stem closure 89 and outer wall 91 of the plug portion 76 of the stem member 75 into internal cavity formed by and extending therebetween the inner circumferential surface 93 of the marker' body 85, distal edge 94 of the second end 95 of the stem closure 89 and outer circumferential surface 83 of the projection 81 of the plug portion 76 of the stem member 75. The inner surface 82 cone-shaped projection 81 may circumvent around the outer surface 96 of the collar 84 of the marker's body 85. The depression of the felt applicator, as may be seen in FIG. 18, will compress spring member 97 to separate sealing surface 82 of second end 78 of plug portion 76 of stem member 75 from sealing outer surface 96 of collar 84 of the marker's body 85, which will allow a writing liquid to flow into chamber 87. Such chamber 87 may be formed by and extending therebetween the outer surface of the felt applicator 98 and inner circumferential surface 82 and thus to moisturize the applicator. The cone-shaped projection 81 may have variable length and thickness as long as it provides reasonable sealing closure between a barrel and felt applicator. The cone-shaped projection 81 may have variable length and thickness as long as it provides reasonable sealing closure between a barrel and felt applicator.

Figure 27:
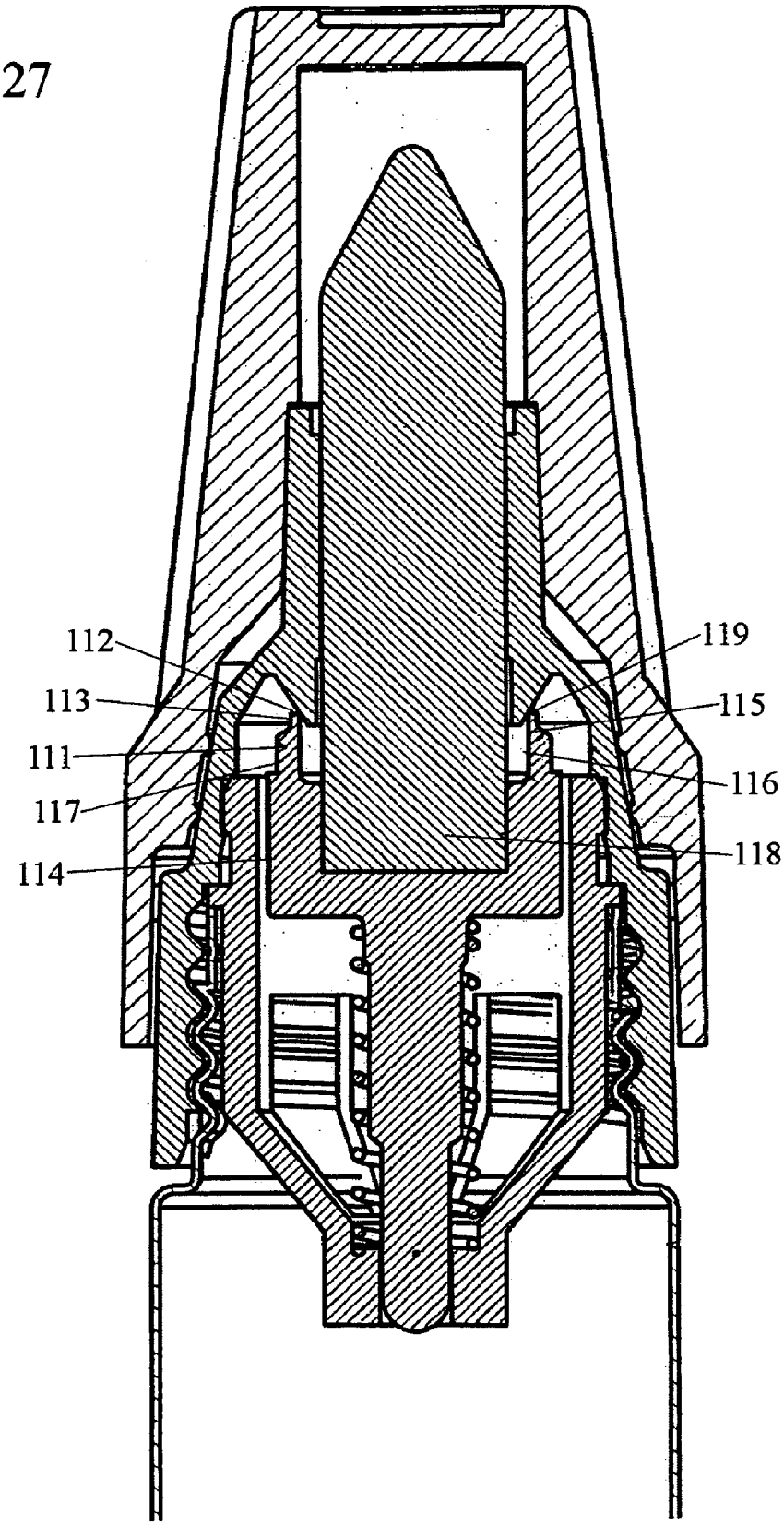
FIG. 27 is a cut-away view of the assembled alternative embodiment of the marker of FIG. 1.

In yet another embodiment of the stem member, as depicted in FIG. 27 the second end 111 of the plug portion 114 may have a projection 115. The projection 115 may have generally cylindrical shape defining inner circumferential wall 116 and two outer circumferential walls 112 and 117 having a diameter of wall 117 generally larger than a diameter of wall 112 separated by the shoulder 113. Although the length of each portion of the second end 111 formed by such walls 117 and 112 may vary, in current embodiment the length of the portion defined by wall 112 may be approximately twice as short as the length of the portion defined by the wall 117. The inner circumferential surface 116 may have generally a diameter at least equal or larger that the distal end of the writing applicator 118 to in order to insertably accommodate and retain such applicator. The outer edge of the second end portion 111 defined by the wall 112 may have a sealing seat 119 to engage the corresponding sealing circumferential surface of the collar of the marker's body as was described in detailed above.

The other portions of the stem member 75 and/or the second end of such member 111 as depicted in FIG. 19, FIG. 20 and/or FIG. 21 and their respective function as independent members or in association with stem closure and/or with marker's body may operate in the same manner as the application mechanism of the stem member, spring member, stem closure and marker's body previously described in FIG. 1 through FIG. 11.

As shown in FIG. 12 and FIG. 13, the cap 17 may be generally conical-shaped with open end 70, closed end 71 and generally conical circumferential sidewalls 72 having inner diameter suitable to frictionally fit the outer circumferential surface of the generally conical portion 67 of the marker's body 12. The sidewalls 72 may be provided with external gripping ribs 73 for aiding in the removal of the cap 17 by a user.

Although only few embodiments of improved marker have been in details described above, those skilled in the art will readily appreciate that many modifications of the exemplary embodiment are possible without materially departing from the novel teachings and advantages of this invention. For example, other embodiments of a stem member, spring member and/or stem closure and/or their interrelations and arrangements may be used instead of those described above. Additionally, forms, embodiments and configurations with certain degree of particularity of a barrel, a marker's body and/or a cap, including their combination and arrangements, variations and modifications are intended to be included within the scope of this invention as defined in the claims.

Other modifications, substitutions, omissions and changes may be made in the design, size, materials used or proportions, operating conditions, arrangement or positioning of elements and members of the preferred embodiment without departing from the spirit of this invention as described in the claims.

We claim:

1. An improved marker for applying a writing material to a surface comprising;

a barrel having a reservoir for containing a writing material;

a marker body connected to said barrel member, said barrel having at least one open end, said marker body being generically cylindrical and having an inside wall, and an outside wall, said inside wall having a a conical projection extending from said inside wall of said marker body, said conical projection having an inner surface and an outer surface;

a stem member having a plug portion and a stem projection, said plug portion having an open end and a closed end with a generally cylindrical side wall between said ends, said open end of said stem having an outer circumferential surface and an inner circumferential surface at said open end, said inner circumferential surface being in a sealing engagement with said outer surface of said conical projection when said plug portion contacts said conical projection of said marker body and an open position when said plug portion is away from said conical projection;

a resilient member for biasing said stem member into sealing engagement with said conical projection of said marker body for the purposes of controlling the flow of said writing material from said barrel into said marker body.

2. An improved marker according to claim 1, wherein said marker body has a first inside wall and a second inside wall and a third connecting wall connecting said first inside side wall to said second inside wall, and wherein said third connecting wall forms said conical projection with said second inside wall.

3. An improved marker according to claim 2, wherein said plug portion contacts said third connecting wall portion, when said plug portion is in sealing engagement with said marker body.

4. An improved marker according to claim 1, wherein said plug portion has a projection that contacts a wall of said conical projection in said marker body to prevent writing material from contacting an applicator.

5. An improved marker according to claim 4, wherein a surface of said projection on said plug portion contacts said third inner connecting wall.

6. An improved marker according to claim 1, wherein said writing material flows from said barrel to said marker body through an internal closure cavity of a stem closure and to an applicator tip when said stem member is in an open position.

7. An improved marker according to claim 6, wherein a first open end of said stem closure is connected with said marker body through a press fitting into a circumferential conical projection of said marker body.

8. An improved marker according to claim 6, wherein said resilient member is a coil spring co-acting between said stem member and said stem closure.

9. An improved marker according to claim 6, wherein said writing material is allowed to flow unimpeded from said barrel member through said internal closure cavity to said conical projection.

10. An improved marker according to claim 1, wherein a connection of said barrel with said marker body includes a thread means.

11. An improved marker according to claim 1, wherein said open end of said stem member frictionally engages the distal end of an applicator tip, and wherein at least one end of said tip is disposed in said stem member.

12. An improved marker according to claim 1, wherein said plug portion of said stem member has a plurality of ribs on its outer surface.

13. An improved marker for applying a writing material to a surface comprising;

a barrel having a reservoir for containing a writing material;

a marker body connected to said barrel member, said barrel having at least one open end, said marker body being generically cylindrical and having an inside wall, and an outside wall, said inside wall having a conical projection extending from at least a portion of said inside wall said conical projection having an inside surface and an outside surface said outside surface being closer to said inside wall of said marker body than said inside surface;

a stem member having a plug portion and a stem projection, said plug portion having an open end and a closed end with a generally cylindrical side wall between said ends, said stem member being in a sealing engagement with said conical projection when said plug portion contacts said outside surface of said conical projection in said marker body and an open position when said plug portion is away from said conical projection.

* * * * *